US005350027A

United States Patent [19]

Mauch et al.

[11] Patent Number: 5,350,027

[45] Date of Patent: Sep. 27, 1994

[54] DRILL MACHINE TABLE

[75] Inventors: Magnus Mauch, Goppingen; Achim Kehrberger, Ostfildern, both of Fed. Rep. of Germany

[73] Assignee: DELMAG Maschinenfabrik Reinhold Dornfeld GmbH & Co., Esslingen, Fed. Rep. of Germany

[21] Appl. No.: 930,509

[22] PCT Filed: Sep. 8, 1990

[86] PCT No.: PCT/EP90/01519

§ 371 Date: Sep. 30, 1992

§ 102(e) Date: Sep. 30, 1992

[87] PCT Pub. No.: WO92/04523

PCT Pub. Date: Mar. 19, 1992

[51] Int. Cl.[5] ..... B23Q 5/00; E21C 5/00

[52] U.S. Cl. ..... 173/216; 173/149; 173/217

[58] Field of Search ..... 173/141, 145, 216, 217, 173/218, 149

[56] References Cited

U.S. PATENT DOCUMENTS

| | | | |
|---|---|---|---|
| 2,533,957 | 12/1950 | Roelfs | 173/216 |
| 3,072,203 | 1/1963 | Bendixen | 173/145 |
| 3,125,172 | 3/1964 | Tilden | 173/145 X |
| 3,316,983 | 5/1967 | Goodman | 173/216 |
| 3,406,768 | 10/1968 | Miller . | |
| 3,973,468 | 8/1976 | Russell . | |
| 4,190,119 | 2/1980 | Loftis et al. | 173/218 X |
| 4,246,974 | 1/1981 | Rothrock . | |
| 4,295,829 | 10/1981 | Martinelli et al. | 173/216 X |
| 4,612,998 | 9/1986 | Vindez | 173/216 X |
| 5,029,655 | 7/1991 | Ebeling | 173/216 X |
| 5,033,554 | 7/1991 | Younes | 173/216 X |

*Primary Examiner*—Rinaldi I. Rada
*Attorney, Agent, or Firm*—Fred Philpitt

[57] ABSTRACT

A drilling machine for a mobile drilling appliance which includes a housing which is adapted to travel along a jobber, a drive motor mounted on said housing, a pinion operatively connected to said drive motor, a step-down gear rotatably engaging said pinion, a driving socket located in the vicinity of a side face of said housing that contains a central opening which is adapted to receive a driving shaft that in turn is adapted to be connected to a drilling tool, and a driving ring positioned in said driving socket and engageable with said step-down gear.

8 Claims, 3 Drawing Sheets

DRILL MACHINE TABLE

The invention relates to a drilling machine table for a mobile drilling appliance.

BACKGROUND

Drilling machine tables of this type are used in known mobile drilling appliances and serve for example for drilling holes in pile foundations.

Sometimes it would be desirable to produce a drill hole also in the immediate vicinity of an already existing building. This is not possible with the known drilling machine tables, since the stepping-down gear has a large diameter, so that then if the drilling machine table is moved close up to a building wall, the drilling axis is at a greater distance from this wall.

SUMMARY OF THE INVENTION

A drilling machine table according to the present invention provide that even drill holes in the immediate vicinity of a building wall can be drilled.

The development of the invention according to one embodiment has an advantage with regard to a simple and exact movement of the drilling tool up to a drilling point located in the immediate vicinity of a building wall, using an excavator supporting the jobber.

The development of the invention according to another embodiment makes it possible to provide drilling machine tables which are already in use, additionally with a driving socket lying close to the edges of the drilling machine table or to produce conventional drilling machine tables and drilling machine tables according to the invention largely using identical standard components.

The development of the invention according to another embodiment has an advantage with regard to the simplest possible subsequent equipping of already existing drilling machine tables. The offtake of the driving movement for the driving socket located at the edge of the drilling machine table from the rotary movement of the step-down gear takes place without any intervention in the interior of the existing conventional drilling machine table; only a few simple add-on parts are used.

With compact dimensions of the power-transmission device, the development of the invention according to another embodiment facilitates a 1:1-translation between the step-down gear and driving socket, i.e. a rotating driving socket with the same speed as the step-down gear. One thus has comparable driving ratios for both power take off points of the drilling machine table.

Also the development of the invention according to another embodiment serves for simple subsequent provision of the invention on already existing drilling machine tables without appreciable intervention in the mechanics of the drilling machine table. In this variation, one can also easily provide an increased speed with respect to the normal drive, at the additional power take off point close to the edge.

According to another embodiment, one obtains a drilling machine table, in which the housing projects only slightly beyond the drilling axis in one direction, so that drill holes can be produced in the immediate vicinity of a building wall, with overall particularly compact dimensions of the housing in the direction perpendicular to the drilling axis (in the case of normal use this corresponds to the direction of travel of the chassis).

BRIEF DESCRIPTION OF DRAWINGS

The invention will be described in detail hereafter by means of embodiments, referring to the drawings, in which.

PREFERRED EMBODIMENTS

Figure 1:
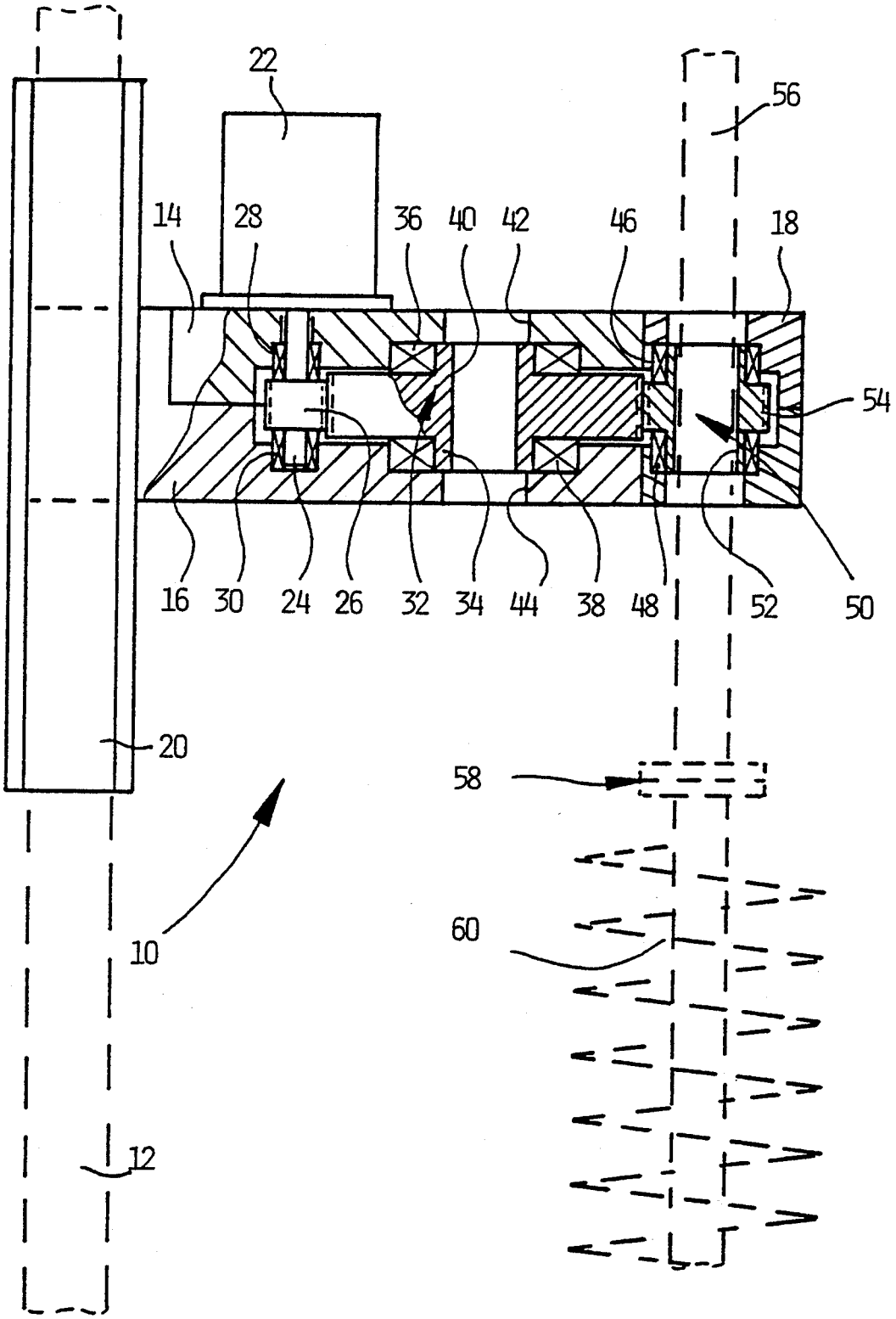
FIG. 1 is a vertical axial section through a drilling machine table with an additional driving socket close to the edge for a drilling tool.

In FIG. 1, a drilling machine table is designated generally by the reference numeral 10, which is able to travel in the vertical direction on a jobber 12 shown in broken line, for example using a rope winch or a hydraulic cylinder (not shown in detail).

The drilling machine table 10 has a main lower housing part 16 and a main upper housing part 14 as well as a divided add-on housing part 18 fitted on the end faces of the main housing parts on the right in FIG. 1. The housing parts 14 to 18 are detachably connected to each other in a manner which is not shown in detail, for example by screws.

Attached to the side face of the main lower housing part 16 located at the front in FIG. 1 is a guide rail 20 having an I-shaped cross-section. Similarly, a second guide rail is fixed to the rear side face of the lower housing part 16. The guide rails 20 cooperate with the side faces of the jobber 12 and thus form the guide for the drilling machine table 10.

A hydraulic drive motor 22 is located on the upper side of the upper housing part 14, the shaft 24 of which motor supports a pinion 26. Bearings 28, 30 serve for mounting the shaft 24 in the drilling machine table housing.

The pinion 26 acts on a step-down gear 32 having a large diameter compared therewith, which gear has integrally formed stub shafts 34. Bearings 36, 38 serve for mounting the step-down gear 32 in the drilling machine table housing.

The step-down gear 32 has a central passage 40 with a square cross-section for receiving a corresponding square drive shaft for a drilling tool. Openings 42, 44 are provided in the main lower housing part 16 and in the main upper housing part 14 above and below the passage 40.

A driving socket 50 is mounted by way of bearings 46, 48 inside the add-on housing part 18. This driving socket 50 has a central opening 52 with the same square cross-section as the passage 40. Integrally formed on the driving socket 50 is a toothed ring 54, which meshes with the step-down gear 32. Compared with the diameter of the step-down gear 32, the toothed ring 54 has a small diameter, so that the axis of the driving socket 50 lies close to the edge of the drilling machine table 10 on the right in FIG. 1.

In FIG. 1, a square driving shaft 56 is shown in broken lines, which passes through the opening 52 with axial sliding clearance. A drill 60 is attached by way of a coupling 58 at the lower end of the driving shaft 56.

As can be seen from FIG. 1, the drill 60 can be rotated into the earth directly in front of a building wall, without the drilling machine table housing striking against the building wall.

However, the drilling machine table 10 illustrated in FIG. 1 may also operate as a conventional drilling machine table: for this purpose one needs to introduce solely one driving shaft 56 into the passage 40 of the step-down gear 32.

If, in the drilling machine table illustrated in FIG. 1, the add-on housing part 18 and the driving socket 50 are omitted and the main housing parts 14, 16 are closed at the right-hand end by a plate, then one acquires a conventional drilling machine table. Thus with largely standardised components, one can construct both drilling machine tables with an additional driving shaft holder close to the edge as well as conventional drilling machine tables.

Conversely it will be seen that when one opens the drilling machine table housing of a conventional drilling machine table at the end face located on the right in FIG. 1, by simply attaching the add-on housing part 18 with the driving socket 50 mounted therein, one creates the possibility of a power take off point close to the edge for the driving movement of the drill.

The construction illustrated in FIG. 1 also has the advantage that driving movements of the drill at different speeds are provided in a mechanically very simple manner.

Figure 2:
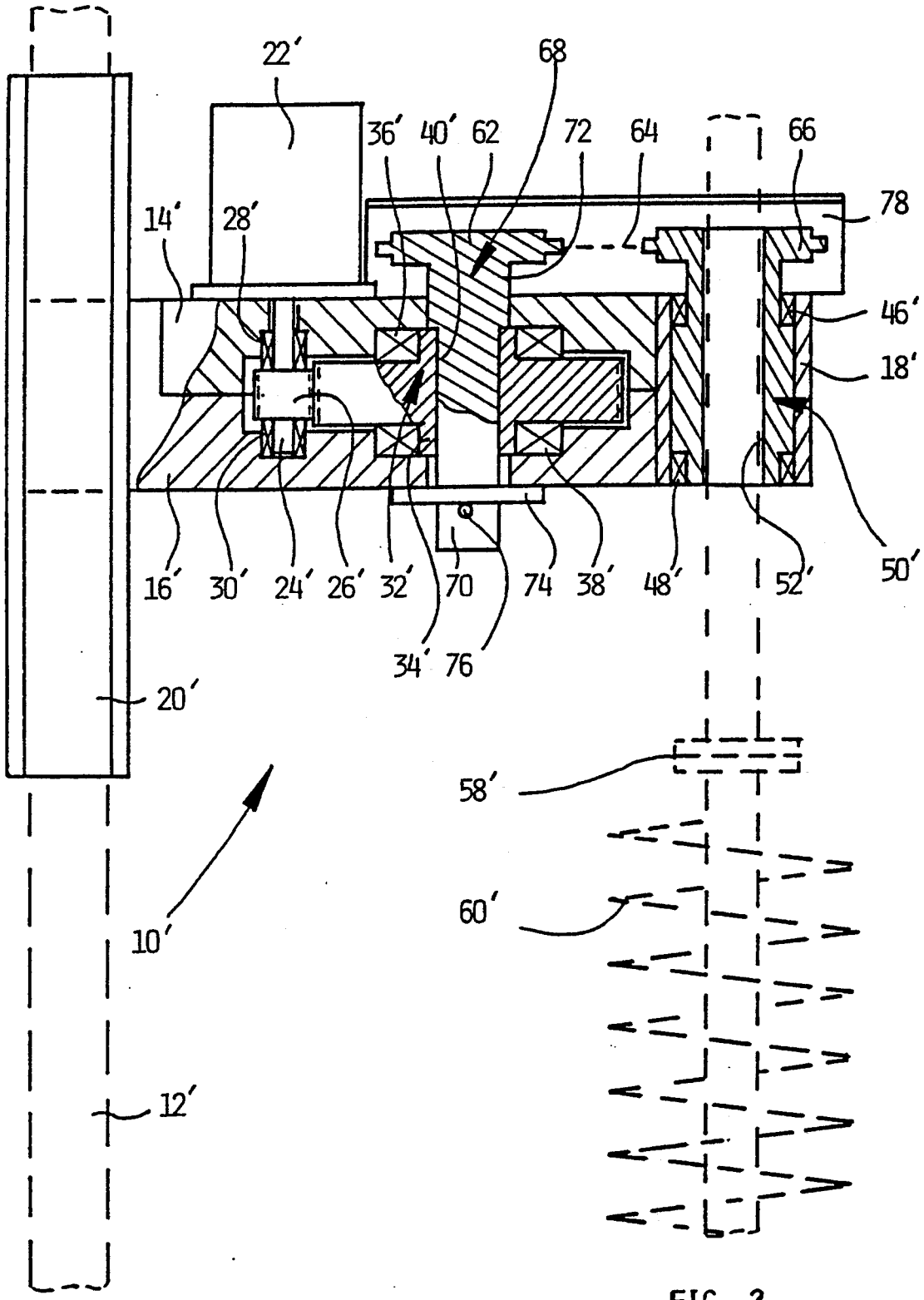
FIG. 2 is a similar view to FIG. 1, in which a modified drilling machine table is illustrated.

FIG. 2 shows a modified drilling machine table, in which the power take off point close to the edge rotates at the same speed and with the same direction of rotation as the power take off point of the conventional drilling machine table. Components which have already been explained with reference to FIG. 1, are again provided with the same reference numeral and will not be described again in detail.

At its upper end guided out beyond the add-on housing part 18', the driving socket 50' supports a chain wheel 66. The latter is driven by a chain 64 shown solely diagrammatically in broken line, which travels over a driving chain wheel 62. The latter is seated at the upper end of a drive part designated generally by the reference numeral 68. This has a square coupling section 70, which fits in a form-locking manner in the square passage 40' of the step-down gear 32', as well as a cylindrical collar 72, by which the driving part 68 is seated on the upper side of the step-down gear 32'. The driving part 68 is undetachably connected to the step-down gear 32' by a washer 74 engaging on the under side of the main lower housing part 14' and a splint 76.

A sheet metal cover 78 surrounds the chain drive, the step-down gear 32' and drive socket 50' for the synchronous rotary movement.

In the variation illustrated in FIG. 2, for the subsequent provision of the power take off point close to the edge, one requires no mechanical interventions in a conventional drilling machine table. One needs solely to screw the add-on housing part 18' onto the main housing, to insert the driving part 68 in the step-down gear 32' and to place the chain 64 over the chain wheels 62 and 66.

Figure 3:
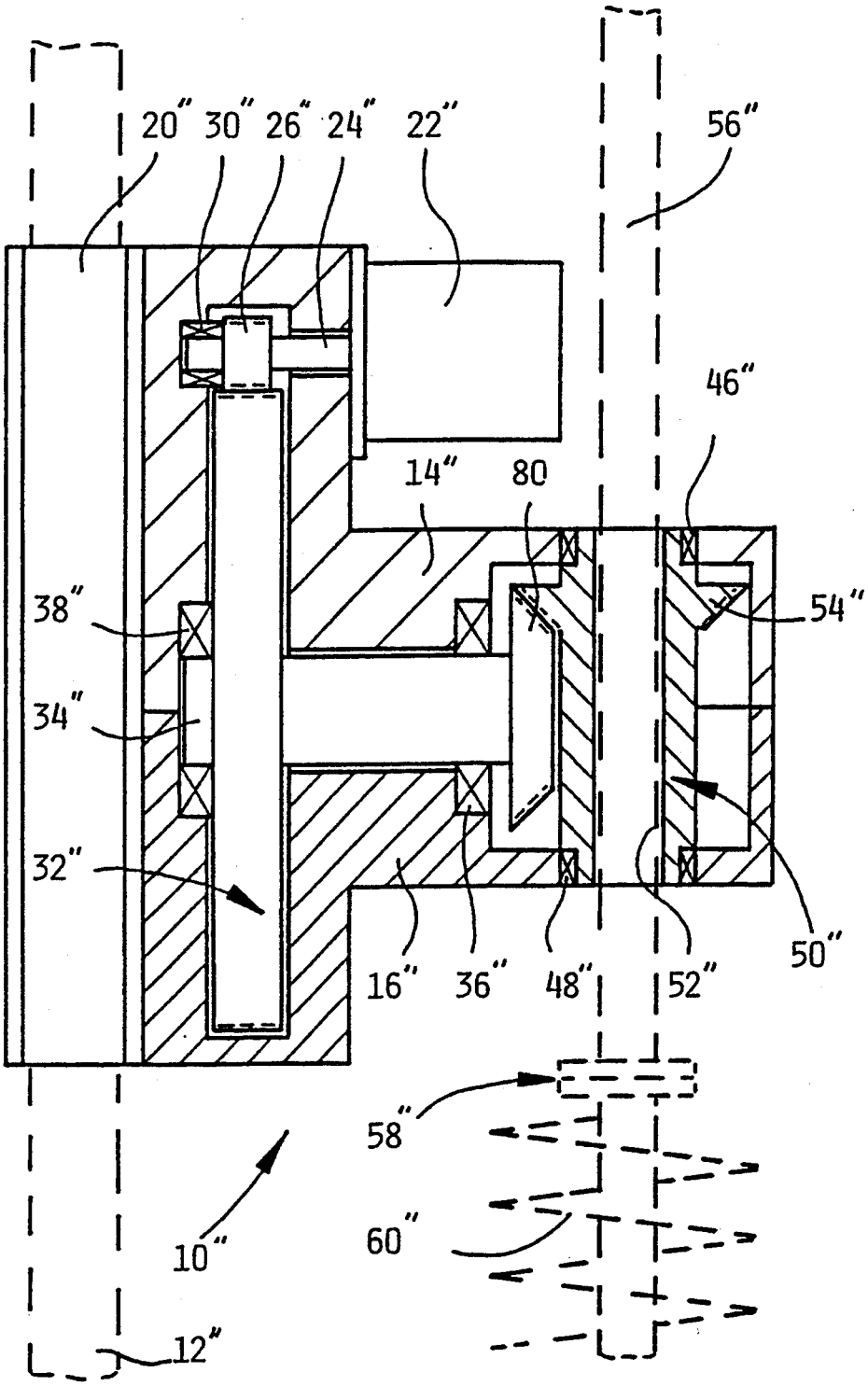
FIG. 3 is a sectional view similar to FIG. 1, in which a drilling machine table which has again been modified is shown.

The modified drilling machine table illustrated in FIG. 3 (wherein components already shown and described relative to FIG. 1 are identified with the same numeral or the same numeral with two added apostrophes). is characterised by particularly small dimensions in the horizontal direction. This is possible due to the fact that the reduction gear 32'' is allowed to rotate in a vertical plane adjacent to the guide rails 20''. In the embodiment according to FIG. 3, components corresponding to components already described above as regards their function are again provided with the same reference numeral or the same numeral with a single added apostrophe.

The stub shaft 34'' extending towards the right away from the step-down gear 32'' in FIG. 3 supports a bevel gear 80 on its right-hand end and the latter meshes with the toothed ring 54'' of the driving socket 50'', constructed in a corresponding bevelled manner.

The embodiment according to FIG. 3 originally offers a power take off point close to the edge for the drill driving movement. It is characterised by a particularly compact construction with only a few mechanical parts and is therefore preferred for the new construction of drilling machine tables, whereas the embodiments according to FIGS. 1 and 2 are preferably used in the subsequent equipping of already existing drilling machine tables.

As a modification of the embodiment illustrated in FIG. 3, one can also locate the drive motor 22'' on the upper side of the main upper housing part 14'', so that the shaft 24'' once more rotates about a vertical axis. The pinion 26'' is then constructed as a bevel pinion, the external toothing of the step-down gear 32'' is then bevelled in a corresponding manner. This makes it possible to shorten the stub shaft 34'' supporting the bevel gear 80, due to which the axis of the driving socket 50'' can be placed even closer to the jobber 12''.

We claim:

1. A drilling machine for a mobile drilling appliance which comprises in combination (a) a housing (14, 16, 18) which is slidably mounted to a jobber (12), (b) a drive motor (22) mounted on a part of said housing, (c) a pinion (26) operatively connected to said drive motor (22), (d) a step-down gear (32) rotatably engaging said pinion (26), the diameter of said step-down gear (32) being large in comparison with the diameter of said pinion (26), (e) a driving socket (50) located in the vicinity of a side face of said housing (18), said socket (50) containing a central non-circular opening (52) receiving in an axially displaceable manner, a driving shaft (56) that in turn is connected to a drilling tool (60), and (f) a driving ring (54) positioned in said driving socket (50) around said opening (52) and engageable with said step-down gear (32), the diameter of said driving ring (54) being small in comparison with the diameter of the surface of said step-down gear (32) that engages said pinion (26).

2. A drilling machine according to claim 1 wherein one side face of said housing (14, 16) is provided with guide means (20) cooperating with the jobber (12).

3. A drilling machine table according to claim 2 wherein said step-down gear rotates in a vertical plane adjacent to the guide means and meshes by way of a small bevel gear with said driving ring, said driving ring being constructed as a bevel gear.

4. A drilling machine according to claim 1 wherein said housing includes a main housing section (14, 16) and an add-on housing section (18) attached to and extending outwardly from a side face of said main housing section (14, 16).

5. A drilling machine according to claim 4 wherein said step-down gear (32) is mounted in said main housing section (14, 16).

6. A drilling machine according to claim 5 wherein said driving socket (50) is mounted in said add-on housing (18).

7. A drilling machine table according to claim 1 wherein said step-down gear (32) has a central, non-circular passage (40) receiving in an axially displaceable manner, a correspondingly non-circular driving shaft, said driving ring (54) as well as said pinion (26) meshing with said step-down gear (32).

8. A drilling machine table according to claim 1 wherein said step-down gear has a central, non-circular passage receiving a drive part that includes a driving chain wheel, said driving socket includes a driven chain wheel, and a chain operatively connects the driving chain wheel with the driven chain wheel.

* * * * *